United States Patent [19]

Fitzpatrick et al.

[11] 4,322,963

[45] Apr. 6, 1982

[54] VALVE STEM BENDER AND/OR MARKER

[75] Inventors: Cecil C. Fitzpatrick, Clarksdale, Miss.; Jimmy C. Spurgat, Rawson, Ohio

[73] Assignee: Cooper Tire & Rubber Company, Findlay, Ohio

[21] Appl. No.: 137,475

[22] Filed: Apr. 3, 1980

[51] Int. Cl.[3] ..... B21D 7/03; B41F 17/22

[52] U.S. Cl. ..... 72/387; 72/321; 101/6; 101/35

[58] Field of Search ..... 72/387, 388, 212, 319, 72/321, 322, 152; 101/5, 6, 8, 35

[56] References Cited

U.S. PATENT DOCUMENTS

| | | | |
|---|---|---|---|
| 1,879,868 | 9/1932 | Breer | 72/388 |
| 1,879,869 | 9/1932 | Breer | 72/217 |
| 1,902,881 | 3/1933 | Morgan | 72/388 |
| 2,038,759 | 4/1936 | Roberts | 101/5 |
| 2,565,646 | 8/1951 | Boyer | 72/217 |
| 3,145,757 | 8/1964 | Sheehan | 72/387 |
| 3,786,668 | 1/1974 | Crees | 72/321 |
| 3,804,006 | 4/1974 | Maquignaz | 101/5 |
| 4,133,198 | 1/1979 | Huda | 72/321 |

*Primary Examiner*—Gene P. Crosby

*Attorney, Agent, or Firm*—Kemon & Estabrook

[57] ABSTRACT

Apparatus for bending valve stems of inner tubes used primarily in truck tires which facilitates locating the area of bending contemporeous with readily controlling the bend angle of the stems. An apertured clevis is pivotally mounted on a housing that is grooved to receive a valve stem, with a cylinder and piston connected to the clevis for actuating same with respect to the housing to effect a bending of the valve stem. The housing contains a cylinder and piston for actuating rack and pinion members with suitable indicia provided on the pinion for imprinting upon the valve stem. The cylinder and piston members for the bender and the marker are controlled by an air lock safety system.

10 Claims, 10 Drawing Figures

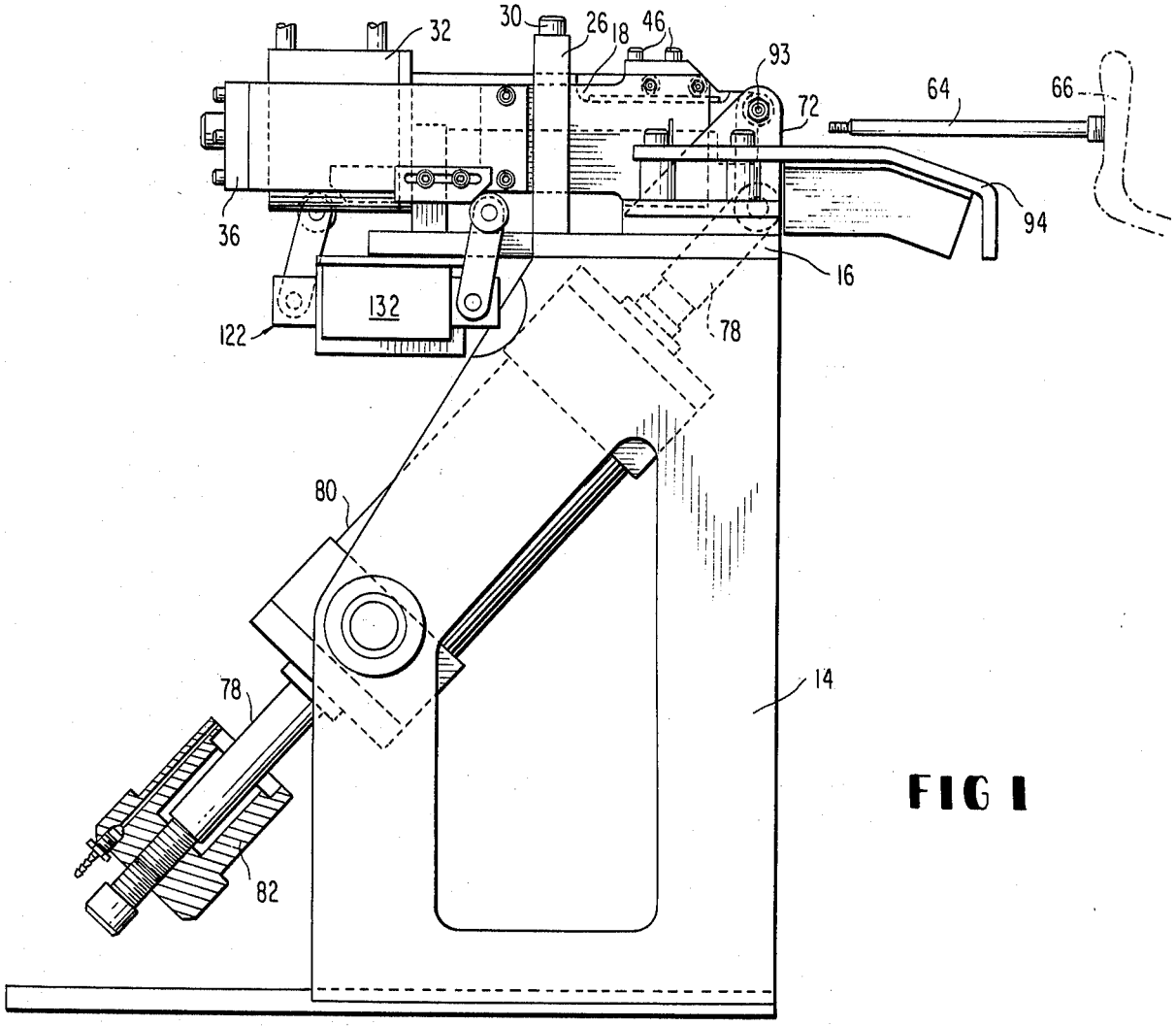
FIG 1
FIG 2
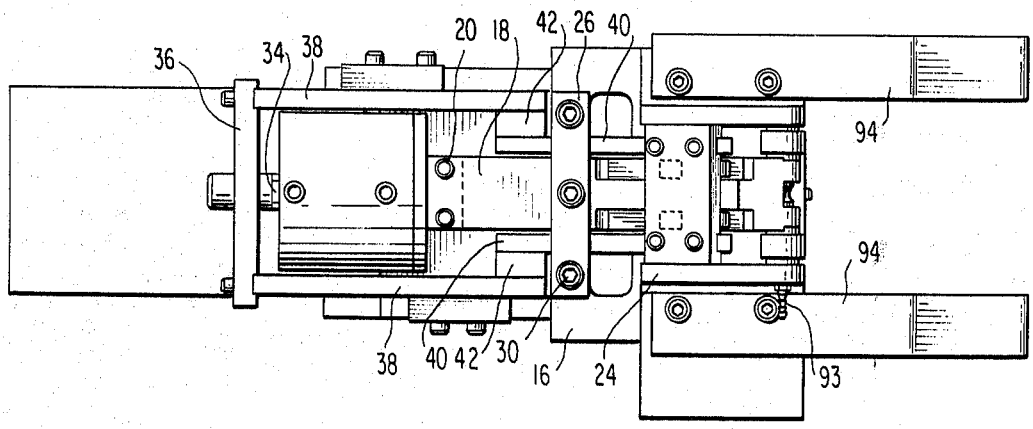

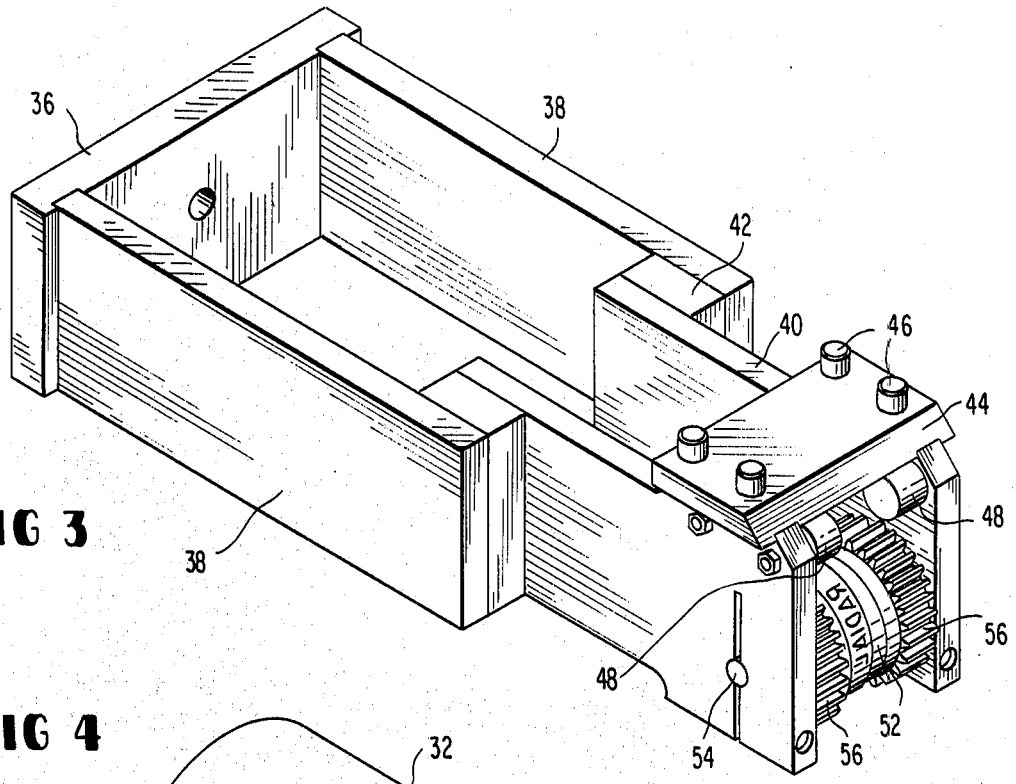
FIG 3
FIG 4
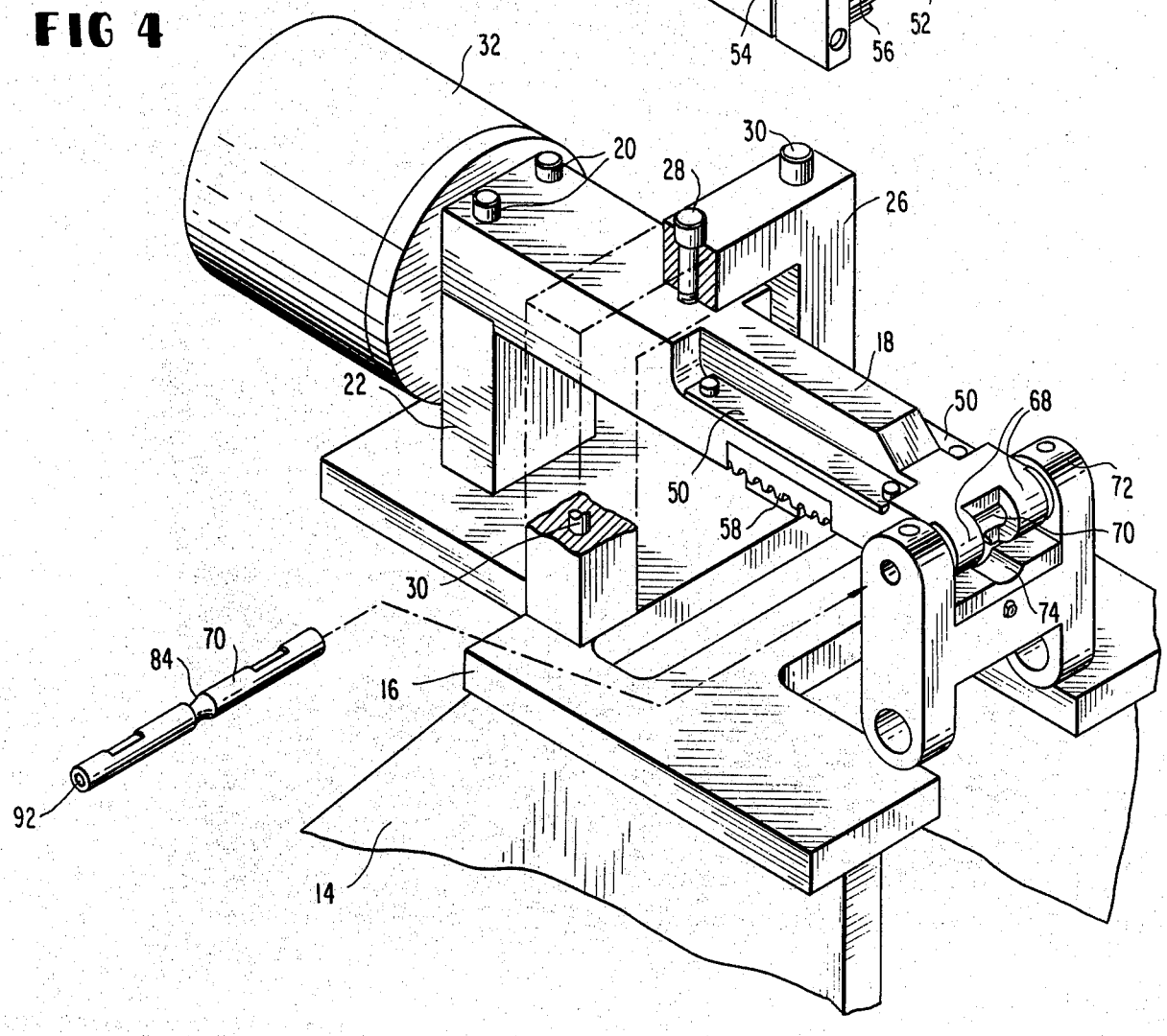

VALVE STEM BENDER AND/OR MARKER

BACKGROUND OF THE INVENTION

An apparatus or tool for bending a valve stem through the use of a roller or roller-like tool element with the tool being movable relative to a stationary work portion of the apparatus during deformation.

Conventional truck inner tube manufacturing processes generally require that the valve stem member remain in straight configuration, normal to the inner tube surface, until after the vulcanization process has been carried out.

The manufacturers of inner tubes for use in radial truck tires have to identify such tubes by some form of marking or indicia to be certain that they are properly used. While a plastic ferrule or a metal ring may be attached to a valve stem or a red stripe or similar marking may be painted on the stem, to so identify their use, the most permanent type or identification is to emboss the word—radial—on the valve stem.

The embossing or imprinting of the word—radial—has, in many instances, been carried out as manual operation wherein a metal die is placed upon the valve stem and then struck with a hammer. In other instances the metal die is mounted in a device whereby all letters or the word—radial—are simultaneously imprinted on the valve stem. In such instances the soft brass body of the valve stem may be bent or distorted during such printing, often to the extent the inner tube-valve stem assembly must be rejected.

In prior art devices inner tube valve stems have been bent by manual-type bending devices such as illustrated in the U.S. Pat. Nos. to Breer 1,879,869 dated Sept. 27, 1932 and Boyer et al 2,565,646 dated Aug. 28, 1951. In said prior art, manually-operated devices, the bending of valve stems is often very inconsistent as regards the bending angle and the bending location. Such devices produced valve stems with bends that were subjected only to visual inspection which resulted in the operations being carried out on somewhat of a trial and error basis.

SUMMARY OF THE INVENTION

The present invention is directed to an apparatus or tool capable of bending and marking inner tube valve stems. The marking and bending functions can be carried out jointly or selectively by means of a control valve setting.

As a result of regulations being imposed upon the trucking industry, to reduce the stopping distance of a vehicle, the truck manufacturers have increased the diameters of the brake drums in an effort to comply. The foregoing has resulted in less space being available for an inner tube valve stem. This is particularly true with regard to the innermost wheels of a dual wheel truck as the increased diameter of the brake drum has resulted in less space being available for the valve stem. In order to prevent damage to the valve stem, due to chafing against the brake drum, it becomes essential that better control be exercised over the bend location and bend angle of the valve stems used with the wheels of a truck and particularly the innermost wheel of a dual wheel arrangement.

The apparatus or tool of the instant application is readily capable of bending inner tube valve stems that will meet the foregoing requirements while also incorporating the necessary means for embossing said stems with the word—radial—when needed. The apparatus or tool is provided with an entrance gate or aperture for receiving a valve stem for the marking and bending thereof through the action of independent air cylinders. To insure that the valve stem has been fully and properly inserted into and through the entrance gate which insures the proper location of the bend in the valve stem, a pneumatic interlock is provided which presents the apparatus or tool from being activated until the stem is fully inserted into said gate.

The marking of the valve stem is carried out by a printing wheel having gear segments engagable with a rack member. A piston and cylinder is actuated for moving a pair of arms carrying the print wheel which operation is controlled by the pneumatic interlock. By sequentially imprinting the letters individually with a gear driven rotary printing wheel, as in the instant invention, the imprinting forces tending to distort the stem are greatly reduced.

BRIEF DESCRIPTION OF THE DRAWING

FIG. 1 is a side elevational view of the bender/-marker of the present invention;

FIG. 2 is a top plan view showing certain portions of the marker and the housing structure containing same;

FIG. 3 is a perspective view of the yoke struction for supporting the marker element;

FIG. 4 is a detailed view showing the housing structure and the piston and cylinder for actuating the yoke structure of FIG. 3;

DESCRIPTION OF THE PREFERRED EMBODIMENT

Figure 8:
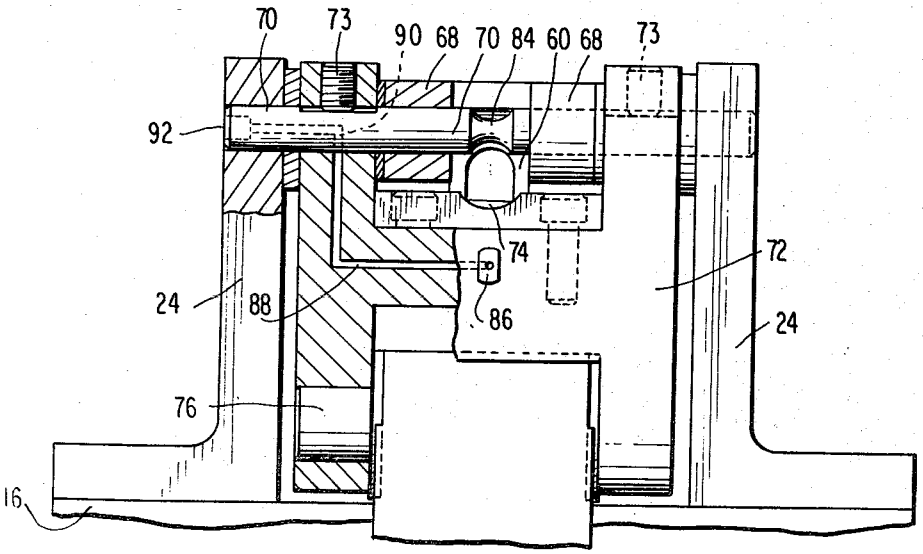
FIG. 8 is an end view of the bender/marker device of the present invention.

Referring to the drawings, there is shown in FIGS. 1 and 4, a base or frame member 14 which has mounted on the top thereof, a supporting platform 16. The platform 16 has superimposed thereupon a housing 18 with one end portion fastened to said platform 16 by means of suitable bolts 20 extending through said housing and through a spacer block 22. The forward end of the housing 18 is carried by a pair of support angle members 24, FIG. 8, which are mounted on the platform 16. The housing 18 is also supported with respect to the platform 16 by means of an arch structure 26 that is secured to the housing by a suitable bolt 28 and to the platform by bolts 30.

Figure 5:
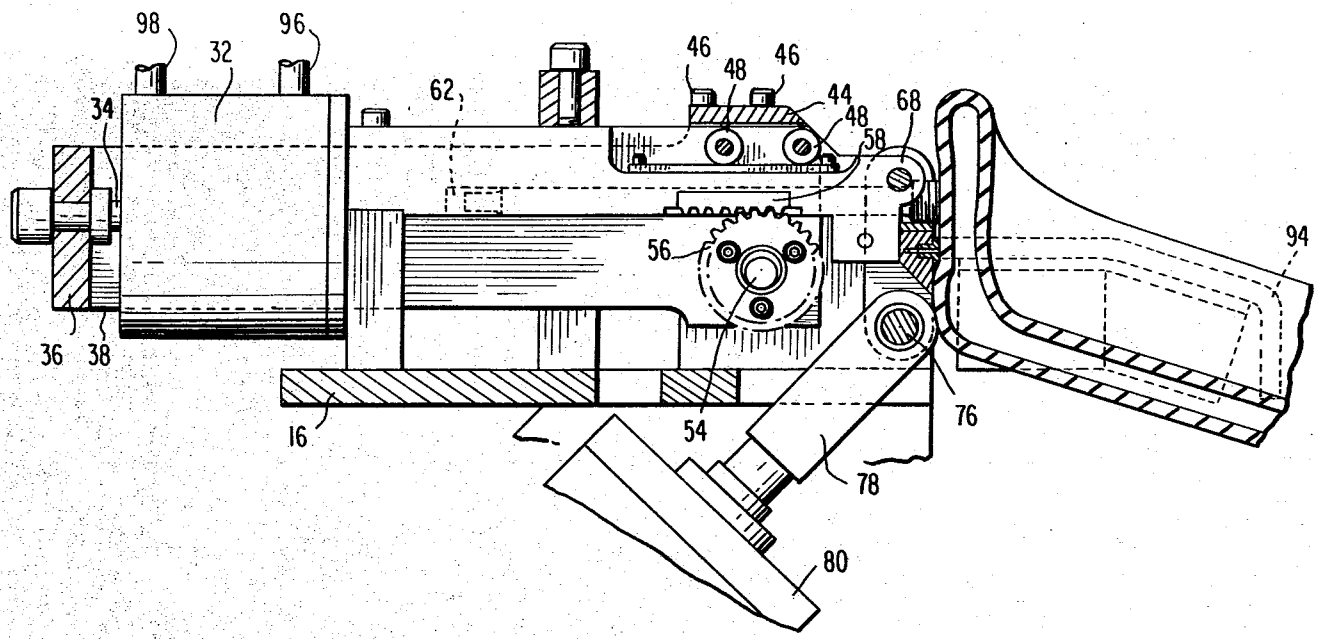
FIG. 5 is a side elevational view showing an inner tube with the valve stem thereof positioned within the housing of the marker device.
Figure 6:
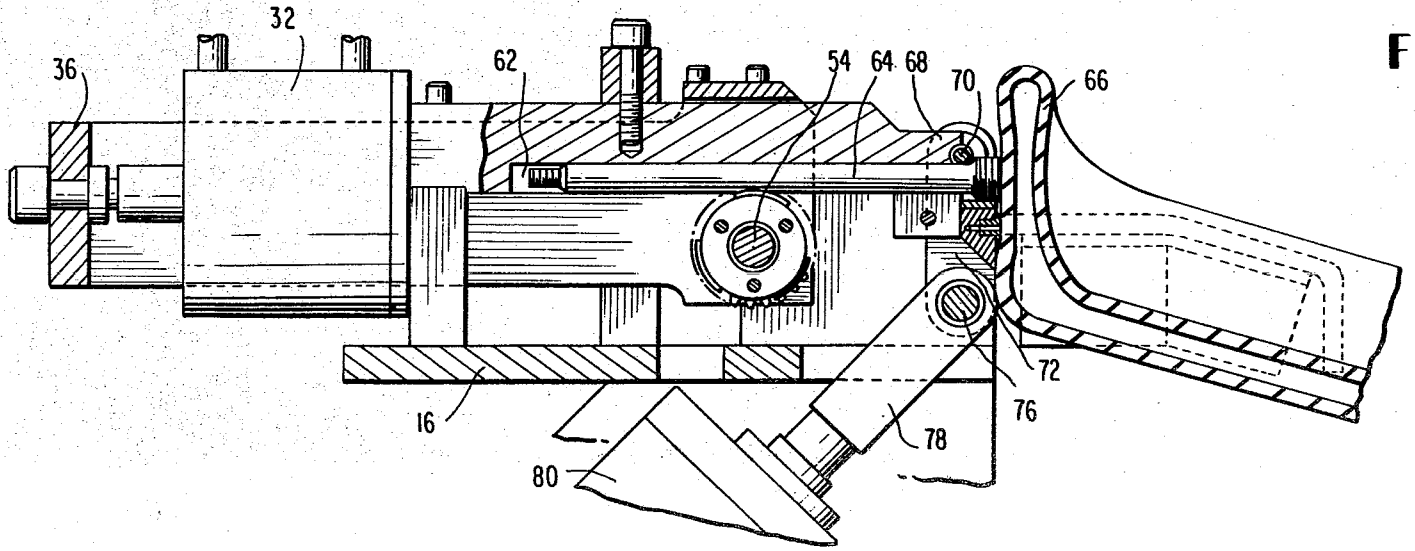
FIG. 6 is a detailed view, particularly in section, showing the marker wheel engaging the valve stem in the marking device.
Figure 9:
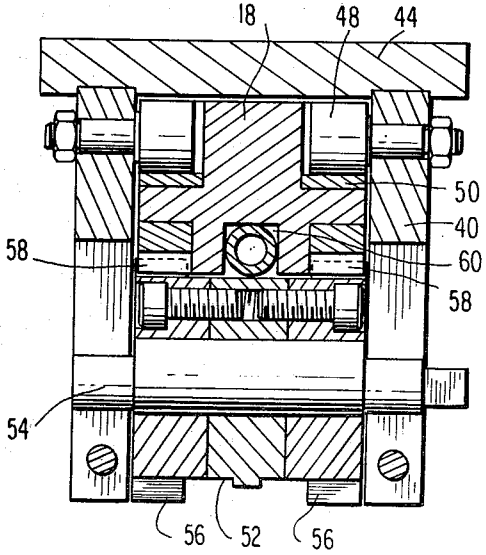
FIG. 9 is a vertical sectional view of the marker wheel and associated parts, the section being taken on the line 9—9 of FIG. 7.

The spacer block 22 has mounted thereon a cylinder-piston 32, with the piston rod 34 being connected to a yoke member 36, FIGS. 5 and 6. The yoke member is provided with a pair of outer leg members 38, FIG. 3, which at their forward ends are connected to a pair of inner leg members 40 by means of spacer blocks 42. The forward ends of the inner leg members 40 are maintained in spaced parallel relation by means of a tie plate 44, which is secured to said leg members by suitable bolts 46. The forward ends of the inner leg members 40 are provided on their inner faces with a plurality of rollers 48, FIGS. 3, 5 and 9, which are adapted to engage suitable trackways 50 provided on the housing 18. The inner leg members 40 are positioned on opposite sides of the housing 18 with the rollers 48 engaging the trackways 50 so that the yoke 36 and the outer legs 38 and inner legs 40 can have a reciprocatory movement with respect to said housing under the action of the cylinder-piston 32.

The forward end portion of the inner legs 40 have positioned therebetween subjacent the rollers 48, a marking wheel 52 which is carried by an eccentric shaft 54 mounted in said inner leg members. The marking wheel 52 is provided with drive gears 56 which are adapted to engage rack elements 58 that are provided on opposite sides of the housing 18 subjacent the trackways 50. The marking wheel 52 is formed with suitable indicia thereon, such as the word "radial" which is positioned on said wheel at intervals of 120°.

Thus, as the word wears down on one segment of the wheel, said wheel may be indexed upon its shaft to being a new word segment into operative relation so as to be certain that when the marking wheel is rotated, the word carried thereon is suitably impressed upon the item or article that is being marked. The eccentric shaft 54 is susceptible of ready adjustment with the inner leg members 40 to properly position the indicia upon the printing wheel so that same will readily engage and mark the item that is positioned with respect to the wheel in the manner as shown in FIG. 6. Thus, with the yoke member 36 connected to the piston rod 34 of the cylinder 32 and with the inner legs 40 arranged on opposite sides of the housing 18 the actuation of the piston within the cylinder 32 will result in the yoke member 36 being moved away from the cylinder 32 which movement causes the outer and inner legs 38 and 40 to be moved with respect to the housing 18 wherein the rollers 48 carried by the inner legs 40 will move over the trackways 50 of the housing at the same time that the gear wheels 56 are engaging the rack elements 50 so as to rotate the print wheel 52 into position thereby imprinting upon a stem positioned within the housing 18. The end of the housing 18 is provided with a suitable aperture 60, FIGS. 8 and 9, that communicates with an elongated channel 62, FIGS. 5 and 6, that is designed to receive a valve stem 64, provided on an inner tube 66.

The forward end of the housing 18 extends outwardly beyond the ends of the inner leg members 40 and terminates in a pair of spaced bosses 68, FIGS. 4 and 6, which are adapted to receive a shaft 70 that has a clevis 72 mounted thereon. The clevis is secured to said shaft 70 by set screws 73 with the ends of the shaft mounted in the support members 24 so that in the clevis and shaft move as a unit in said support members. The clevis 72 is formed with a trough 74 that registers with the aperture 60 provided in the forward end of the housing 18 with said trough 74 configured to receive and support a valve stem 64 when same has been inserted into the housing 18. The lower end of the clevis 72 is provided with a pair of bosses 75 which are rotatably connected by means of a pin 76 to the end of a piston rod 78 that extends through a slot in the end of the platform 16 and which is connected to a cylinder 80 pivotally mounted upon the base or frame member 14. The piston rod projects from the other end of the cylinder 80 and has threadedly mounted thereon, an adjustable control member 82.

Figure 7:
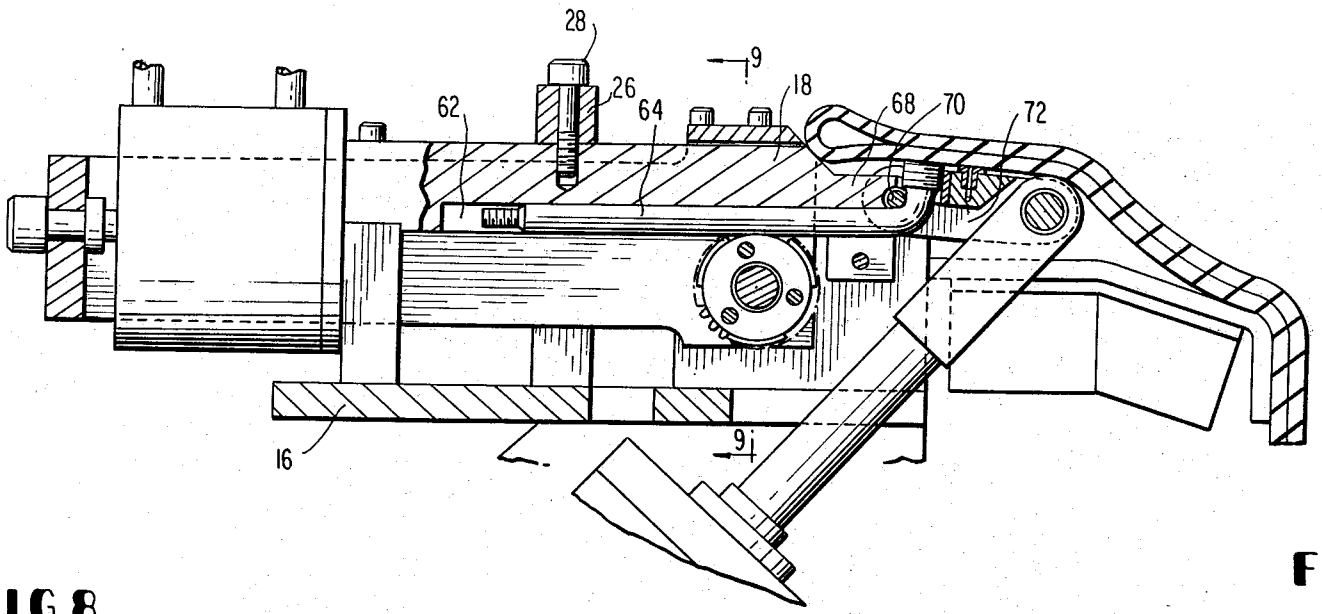
FIG. 7 is a side elevational view, partly in sections, showing the bending piston and cylinder and its associated clevis with the valve stem having been bent.

The shaft 70 upon which the clevis 72 is mounted is formed with a reduced central portion 84 which cooperates with the trough or aperture 74 provided in said clevis 72 for receiving and holding the valve stem 64 of the inner tube 66. The trough 74 constitutes the portion of the clevis 72 that receives and holds the valve stem and said trough is the portion of the clevis which forces the valve stem about the reduced central portion 84 of the shaft 70 when the clevis 72 is pivoted by the action of the piston 78. The clevis 72 has formed in the forward face thereof an aperture 86, FIG. 8, which communicates with an internal passageway 88 provided in said clevis and which passageway in turn communicates through an aperture 90 and passageway 92 in the shaft 70, FIG. 8. The passageway 92 is provided with a nipple fitting 93, FIGS. 1 and 2, in the end of the shaft 70, FIG. 2. The support angle plates 24 each have an outwardly projecting arm 94 which serves as a support for holding the inner tube 66 while the valve stem 64 is being marked and/or bent in the manner as shown in FIGS. 6 and 7.

Figure 10:
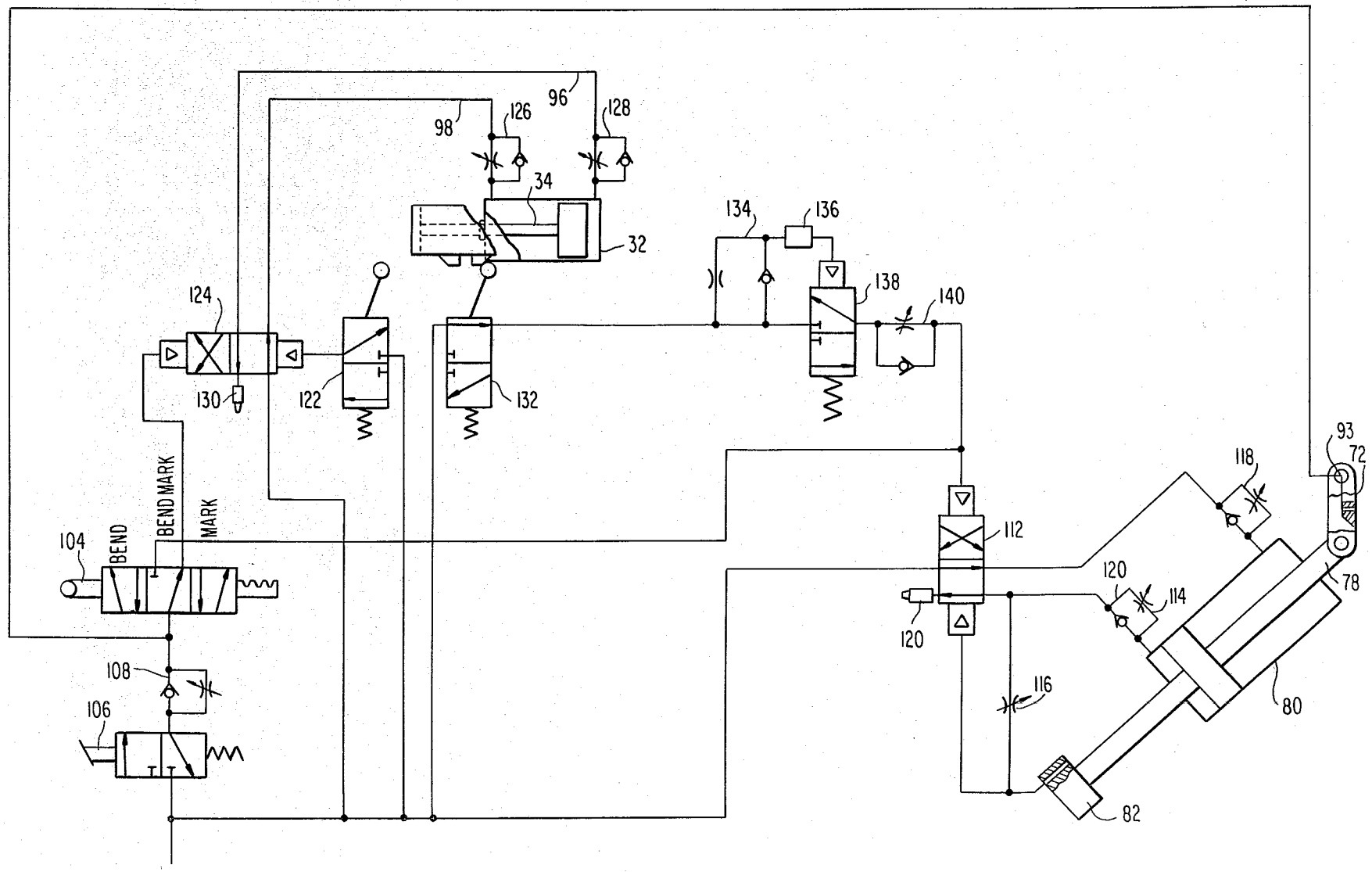
FIG. 10 is a flow diagram of the pneumatic system for actuating the bender/marker of the present invention.

Upon applying pneumatic pressure to the system from an air source the apparatus components will all be moved to the positions illustrated in FIG. 10, said positions being referred to collectively as "equilibrium". In the use of the bender/marker of the present invention and assuming that only a bending operation is to be carried out, the hand aperture selector valve 104, FIG. 10, is moved to the "Bend" position. When the operator depresses the pedal valve 106, it will permit air to flow therethrough from a source of supply through the adjustable orifice of flow control member 108. In the event that an inner tube valve stem 64 has not been inserted through the aperture 60 in housing 18 and into channel 62 so that the rubber portion of the tube does not cover the aperture 86 of clevis 72 thereby permitting the escape of air therefrom, then the air flowing through valve 106 and flow control member 108 will escape through bleeder orifice 86 and the line between bleeder orifice 86 and pneumatic valve 112 will not be pressurized sufficiently to activate valve 112. If the aperture 86 is blocked by the inner tube then the line from selector valve 104 and valve 112 will be pressurized thereby causing the ported spool of valve 112 to shift so that the port configuration of the upper square is shifted into operating position. Following such operation of valve 112 air will then be directed into flow control check valve 114 and needle valve 116. The small amount of air permitted to flow through needle valve 116 readily escapes through the bleeder orifice activator feature of the adjustable control member 82 thereby preventing pressurizing of the alternate control line to valve 112. With valve 112 in this position air passing through said valve will also pass through flow control check valve 114 into the bottom portion of cylinder 80 thus urging piston rod 78 outwardly away from the cylinder. This movement of the piston rod 78 actuates clevis 72 resulting in the pivoting of same and the bending of the stem 64. The stroke speed of the piston in cylinder 80, during the bending stroke, is accomplished by the adjustable feature of flow control valve 118.

Upon the termination of the bending stroke of piston 78 as determined by the adjustable control member 82 coming into contact with cylinder 80 which temporarily blocks the flow of air from the bleeder orifice activator feature of adjustable control member 82. While this blocking action is temporary it permits a momentary pressure buildup in the lines connecting control member 82, needle valve 116 and valve 112 so that the pressure increase causes movement of valve 112 to the equilibrium port configuration. With valve 112 in this configuration air from the supply source will pass through valve 112, through the by-pass check valve of flow control member 118 and into the upper end of cylinder 80 thereby urging the piston and piston rod 78 into a retracted position. The rate of retraction of the piston and piston rod is controlled by flow control member 114 which regulates the exhaust air flow from the lower portion cylinder through control valve 112 and silencer 120.

Assuming that only a marking operation upon a valve stem is to be carried out the selector valve 103 is moved to the "Mark" position. Schematically, the port configuration will be depicted in the "Mark" position square as shown in FIG. 10.

At pressurized equilibrium the limit valve 122 is in the position as shown, thereby blocking flow of air from the source and exhausting the control line from limit valve 122 to control valve 124. At the same time control valve 124, at pressurized equilibrium, will permit air to flow from the source of supply through valve 124 and the check valve of flow control member 126, thereby urging the piston in cylinder 32 to its retracted position shown.

Upon depressing the pedal of valve 106, the port configuration as shown in the lefthand square is moved into position, thereby permitting a flow of air to pass through tthe adjustable orifice of flow control member 108. In the event that a valve stem has not been placed in the trough 74 and inserted through the aperture 60 of the housing 18 so that the inner tube covers and blocks the escape of air through the aperture 86 then the volume of air flowing through valve 106 and limited by flow control member 108 will escape through aperture 86 and the line between aperture 86 and valve 124 will not be pressurized sufficiently to activate the valve 124.

On the other hand, if the valve stem is properly positioned in channel 62 in housing 18 and the inner tube is pressed against aperture 86 and blocking the escape of air, then the line from selector valve 104 to control valve 124 is pressurized, thereby causing the ported spool of valve 124 to shift so that the port configuration of the lefthand square is shifted into operating position. In said operating position, valve 124 will permit air to pass to flow control member 128 where the air will pass through the check valve by-pass thereof and enter the upper portion of cylinder 32, through conduit 96, and urge the piston therein in its operating direction so as to move the yoke 36. The rate of linear travel of the piston is regulated by the controlled flow of air from the opposite end of cylinder 32 through conduit 98 and through the adjustable orifice of flow control member 126 and then through the control valve 124 and the silencer 130.

Simultaneous with the above, a cam member on the piston rod 34 disengages the control arm of limit valve 132, thereby shifting the ported spool thereof to the position depicted by the lower square as shown in FIG. 10. Upon accomplishment of said spool position change, air from the supply source is blocked at limit valve 132 and the pressurized air in the line from limit valve 132 to what is variously referred to in the trade as a "pulse valve" or "one shot", the combination of items 134, 136 and 138, is exhausted to atmosphere through limit valve 132. This "pulse valve" exhausting results upon the actuation of the yoke member 36 resulting in the inner legs 40 moving the gear wheels 56 over the rack elements 58 to rotate the marking wheel 52 along the valve stem 64 to imprint the word—radial—thereon. The "pulse valve" assembly has been shown schematically as the combination of a flow control valve 134, volume chamber 136 and spring return control valve 138. Upon the release of air pressure from control valve 138 and related flow control member 134 and volume chamber 136, by exhausting same through limit valve 132, the spring of control valve 138 urges the ported spool thereof to the position depicted in the bottom square thereof.

Upon the completion of the operational stroke of piston rod 34 of cylinder 32 a cam member on the outer leg member 38 engages the control arm of limit valve 122 thereby shifting the ported spool thereof to the position depicted by the bottom square of FIG. 10. Upon the accomplishment of said spool position change, air from the source of supply through said limit valve 122 and activates control valve 124 so that the ported spool thereof is returned to the equilibrium position as shown in FIG. 10. With the spool of control valve 124 in said equilibrium position, supply air from the source of supply will pass through line 98 and through the check valve by-pass portion of flow control member 126 into the bottom portion of marking cylinder 32 thereby urging the piston and rod 34 in the direction of retract. The rate of linear travel of said piston and piston rod 34 is limited by flow control member 128, the air passing therethrough to control valve 124 and exhausting to atmosphere through silencer 130.

Upon return of the piston and piston rod 34 of cylinder 32 a cam member on the outer leg member 38 engages the control arm of limit valve 132 shifting the ported spool thereof to the upper position. This spool position change permits the air from the source of supply to pass through said limit valve 132 and to control valve 138 for which the ported spool thereof has been shifted to the position depicted by the left square thereof as shown in FIG. 10 by previously described actions of a cam member on the piston rod 34 of cylinder 32 and limit valve 132. At this point supply air flows through control valve 138 and through the check valve by-pass feature of flow control member 140 and into the line connected to both the control valve 112 and the exhaust port of selector valve 104 which is open to the atmosphere in this condition of only marking the valve stem. Since the line connecting flow control member 180, control valve 112 and selector valve 104 is open to atmosphere, sufficient pressure cannot build to activate control valve 112 which would otherwise initiate the bending cycle. Control valve 138 will allow a supply of air to pass through until such time that a sufficient volume of supply air passes through flow control member 134 to fill and pressurize the volume chamber 136 which in turn will urge the ported spool of control valve 138 to the equilibrium position as shown in FIG. 10.

At this point all components of the pneumatic system have been returned to the pressurized equilibrium position as illustrated in FIG. 10.

Selection of the Bend-Mark Mode is accomplished by moving the hand operated selector valve 104 to its Bend-Mark position. Schematically, the port configuration for this mode is shown in operating position in FIG. 10.

As designed, the pneumatic system, if operated in the Bend-Mark Mode, will perform the marking function first, followed by the bending function.

Upon depressing the pedal of valve 106, the port configuration illustrated in the lefthand square is moved into position, thereby permitting a flow of air to pass through the adjustable orifice of flow control 108. In the event a tube stem has not been placed in the aperture 74 provided in clevis 72 and in the channel 62 in housing 18 thereby permitting the rubber portion of said tube to block the escape of air from aperture 86 then the limited volume of air passing through flow control member 108 will escape through aperture 86 and the line between aperture 86 and control valve 124 will not be pressurized sufficiently to activate said valve 124.

If, on the other hand, such a valve stem and attached tube are in position for marking and bending and the tube surface is pressed against aperture 86, thereby blocking the escape of air therefrom, then the line from flow control member 108 through selector valve 104 to control valve 124 is pressurized, thereby causing the ported spool of control valve 124 to shift so that the port configuration of the lefthand square is shifted into the operating position depicted in the schematic of said control valve 124. In said operation position, said control valve 124 will permit supply air to pass to flow control member 128 wherein, passing through the check valve by-pass thereof, enters the upper portion of marking cylinder 32, urging the piston and piston rod 34 thereof in its operating direction. The rate of linear travel of said piston is regulated by the controlled flow of air from the opposite end of cylinder 32 through the adjustable orifice of flow control member 126 and then through a port of control valve 124 being finally exhausted through silencer 130.

Upon reaching the end of its retraction stroke, the outer arm member 38, by means of a cam member, engages and operates limit valve 132, thereby moving the ported spool thereof to the equilibrium position shown in FIG. 10. It is the operation of limit valve 132 at this point that marks the end of the marking cycle and initiates the bending cycle.

In its equilibrium position, limit valve 132 permits a flow of air from the supply manifold to pneumatic device variously referred to in the trade as a "pulse valve" or "one shot". For ease of explanation, the "pulse valve" assembly has been shown schematically as the combination of flow control member 134, volume chamber 136 and spring return control valve 138. In its depressurized state the ported spool of control valve 138 will be spring-urged into the position illustrated by the lower square of FIG. 10. In that position, a straight-through port connects limit valve 132 to flow control member 140.

Upon return of limit valve 132 to its equilibrium position, air from the supply manifold passes through valve 132, through the open port of control valve 138 and on to flow control member 140 whereupon, passing through the check valve by-pass of member 140, activates control valve 112, moving its ported spool so that the function described by the upper square of its schematic symbol is in operating position.

Simultaneous with the above and due to the air source pressurizing those lines which connect control valve 112 to control valve 138 and selector valve 104, the restricted flow of air through the orifice of flow control member 134 will result in the accumulation of air in chamber 136. Upon reaching a predetermined pressure in chamber 136, the pneumatic activator motor of control valve 138 will be operated, thereby shifting the ported spool thereof to the position shown when control valve 138 is in pressurized equilibrium. Control valve 138 will remain in that position as long as the piston rod 34 in cylinder 32 remains in its fully retracted position, thereby holding limit valve 132 in the equilibrium position shown.

Referring again to control valve 138, it will be noted that in its pressurized equilibrium position, shown in the schematic, the control line from control valve 112 through flow control member 140 is ported to atmosphere by control valve 138 thereby bleeding all air from that control line circuit.

Having been activated in this manner by the pulse action of control valve 138, control valve 112 will assume the configuration shown schematically by the upper square of the diagram of FIG. 10. In this ported configuration, air from the supply manifold will pass through control valve 112 and into the lines connecting flow control 114 and needle valve 116.

The small volume of air passing through needle valve 116 will readily escape to atmosphere through the adjustable control member 82, thereby preventing a premature pressure build-up in the companion line connected to the lower controller of control valve 112.

Simultaneously, the supply air passing through control valve 112 will pass through the check valve by-pass of flow control 114 and enter cylinder 80 thereby urging the piston and piston rod 78 in the operational direction. The rate of linear travel of said piston is regulated by flow control 118 from where the displaced air passes through control valve 112 and is exhausted through silencer 120.

Upon reaching the limit of its operational stroke the piston and piston rod 78 of cylinder 80 is physically stopped by adjustable control member 82 coming in contact with the cylinder head of cylinder 80. Upon making such contact, the orifice in adjustable control member 82 is momentarily blocked, thereby creating a momentary pressure build-up of sufficient duration and magnitude to activate control valve 112 thereby returning its ported spool to the equilibrium position illustrated in FIG. 10. This change in the position of control valve 112 permits air from the supply manifold to pass through the check valve by-pass feature of flow control 118 and enter cylinder 80 thereby urging the piston and piston rod 78 in its retract direction. The rate of linear movement of said piston is controlled by the escape of air from the opposite end, through flow control 114 and then through control valve 112 finally exhausting from silencer 120.

At this point, the Marking-Bending functions of the apparatus are complete, the processed valve stem may be removed and all components of said apparatus have returned to their pressurized equilibrium positions, ready to repeat their intended operations on the next valve stem.

Although the foregoing description is necessarily of a detailed character in order that the invention may be completely set forth, it is to be understood that the specific terminology is not intended to be restrictive or confining, and that various rearrangements or parts and modifications of detail may be resorted to without departing from the scope of spirit of the invention as herein claimed.

I claim:

1. An apparatus for bending/marking inner tube valve stems comprising a base member;

a housing secured to said base member;

a cylinder and piston secured to an end of said housing;

a yoke member secured to said piston with the leg portions of said yoke extending in spaced parallel relation to one another along opposite sides of said cylinder and housing;

a pair of side plates carried by said housing;

a clevis member pivotally mounted on the other end of said housing with an aperture in said clevis registering with the interior of said housing for receiving a valve stem;

the free ends of said leg portions having an eccentric shaft mounted therein;

means having indicia thereon carried by said shaft;

a cylinder and piston connected to said clevis;

a source of compressed air;

a pneumatic system connected to said cylinders and said source of compressed air for actuating said piston and yoke to initially move said leg portions and move said means into engagement with a valve stem in said housing and to then pivot said clevis to bend said valve stem.

2. An apparatus for bending/marking inner tube valve stems as set forth in claim 1 wherein said clevis has a safety valve therein connected to said pneumatic system to maintain said system in an inoperative condition until an inner tube valve stem is properly seated in said aperture and in said housing so as to seal said safety valve and make said pneumatic system operative.

3. An apparatus set forth in claim 1 wherein said means constitutes a print wheel having drive gears engagable with rack elements formed on the end portions of said housing.

4. An apparatus as set forth in claim 1 wherein said pneumatic system is provided with a selector valve to permit the bending and marking operations to be actuated jointly or selectively.

5. An apparatus as set forth in claim 2 wherein said other end of said housing is provided with a pair of spaced supports secured to said base member, a mandrel pin having a grooved segment mounted in said supports, said clevis member mounted on said mandrel pin with the aperture in said clevis registering with said grooved segment for receiving a valve stem.

6. An apparatus for marking inner tube valve stems comprising a base member having a housing secured thereto;

rack members secured to the sides of said housing;

a cylinder and piston secured to an end of said housing;

a yoke member affixed to said piston with the leg portion of said yoke extending in spaced parallel relation to one another along opposite sides of said cylinder and housing;

an eccentric shaft mounted in the ends of said leg portions;

a print wheel mounted on said shaft and having gears engagable with said rack elements;

said housing having an opening for securing a valve stem;

a source of compressed air;

a pneumatic system connecting said cylinder and piston to said source of compressed air for actuating said yoke to rotate said print wheel for marking said valve stem.

7. An apparatus as set forth in claim 5 wherein said print wheel is adjustable on said shaft for varying the depths of the marking upon the valve stem.

8. An apparatus for bending inner tube valve stems comprising a base member having a housing secured thereto;

a pair of spaced supports provided at an end of said housing and secured to said base member;

an elongated slot provided in said housing and extending from said end;

a mandrel pin having a grooved segment mounted in said supports;

a clevis member mounted on said pin with a aperture in said clevis registering with said grooved segment for receiving a valve stem;

a cylinder and piston mounted on said base member with said piston connected to said clevis;

a source of compressed air;

a pneumatic system connected to said cylinder and said source of compressed air for pivoting said clevis about said pin and bending said valve stem about said grooved segment.

9. An apparatus as set forth in claim 8 wherein said piston projects from both ends of said cylinder with one end of the piston connected to said clevis, the other end of said piston having a nut mounted thereon, said nut having a passageway therethrough with a connection to said pneumatic system, said nut engaging said cylinder upon the movement of said piston rod and clevis to reverse said pneumatic system and return said piston rod and clevis to their inoperative position.

10. An apparatus as set forth in claim 9 wherein said nut is adjustable on said piston rod to limit the stroke of said piston rod and the pivotal movement of said clevis.

* * * * *